United States Patent [19]

Kobayashi et al.

[11] Patent Number: 5,003,133

[45] Date of Patent: Mar. 26, 1991

[54] MULTISTAGE PUSHBUTTON DEVICE AND A METHOD FOR MANUFACTURING SAME

[75] Inventors: Shigetoshi Kobayashi; Miho Ariga, both of Tokyo, Japan

[73] Assignee: Clarion Corporation Ltd., Tokyo, Japan

[21] Appl. No.: 452,695

[22] Filed: Dec. 18, 1989

[30] Foreign Application Priority Data

Jan. 27, 1989 [JP] Japan ..... 1-16262
Nov. 7, 1989 [JP] Japan ..... 1-287843

[51] Int. Cl.[5] ..... H01H 13/70
[52] U.S. Cl. ..... 200/5 A; 200/343
[58] Field of Search ..... 200/5 R, 5 A, 329, 331, 200/332, 335, 341–345; 84/432–436; 235/145 R; 264/239, 241

[56] References Cited

U.S. PATENT DOCUMENTS 4,877,925 10/1989 Kobayashi ..... 200/5 A

*Primary Examiner*—J. R. Scott
*Attorney, Agent, or Firm*—Henry C. Nields

[57] ABSTRACT

A multistage pushbutton device used to drive a push switch has a base, a first and second stage pushbutton members and drive members to drive the push switch. The first and second stage pushbutton members have first and second elastic arms respectively connected with the base at the one end thereof and a pushbutton is respectively provided on the other end of the arm. An elastic second arm is longer than said first arm and is placed at the position behind the first arm where it does not overlap the first arm in the back and forth direction and at least the part of said second arm overlaps at least the part of said first pushbutton in the back and forth direction.

8 Claims, 4 Drawing Sheets

FIG.1
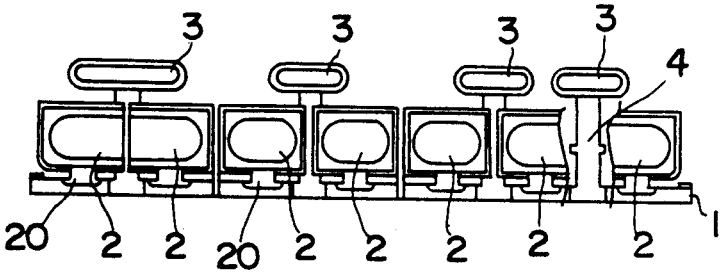
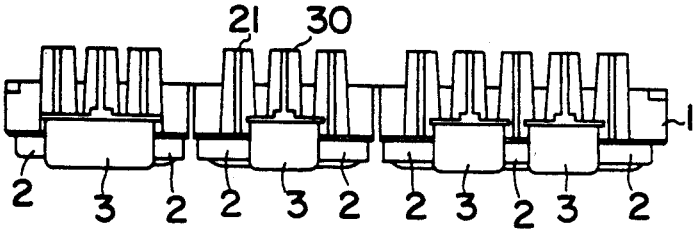
FIG.2
FIG.3
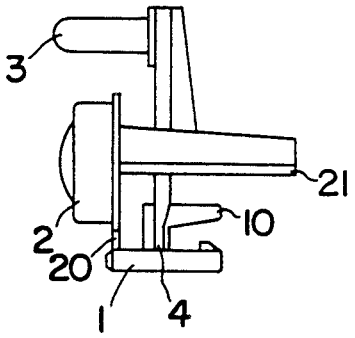
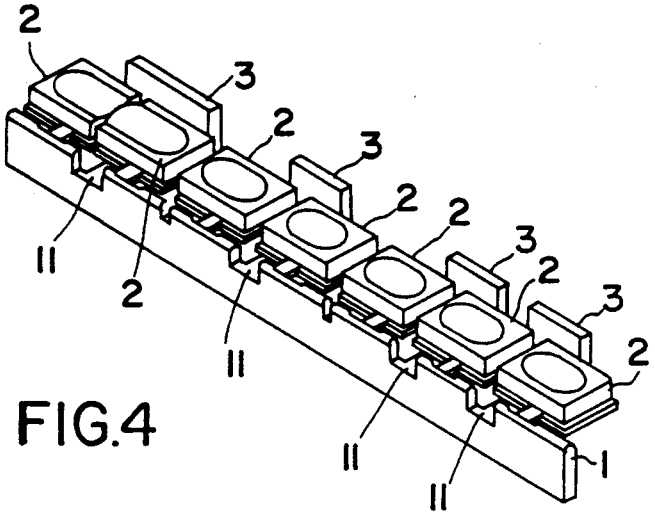
FIG.4

MULTISTAGE PUSHBUTTON DEVICE AND A METHOD FOR MANUFACTURING SAME

FIELD OF THE INVENTION

The present invention relates to a multistage pushbutton device and a method for manufacturing the device.

BACKGROUND OF THE INVENTION

There are known various types of pushbutton devices used in the operating portion of various sorts of electronic devices or the like, in one of which a plurality of buttons are coupled with a base plate by flexible arms respectively. Each button is provided with a drive member at the rear side thereof to drive a push switch.

Such components of the device, namely the buttons, the arms and the drive members are usually formed integrally by molding, which is easy and may reduce the producing cost.

However such unitary structure pushbutton devices of the prior art have only a single stage button array, which limits design of the device and makes it very hard to increase the number of button in the limited space available.

Then the inventors of the present invention provided the idea of the multistage button device shown in FIG. 11, where first buttons 101 are provided on a base 100 in a row across the width of the device. Above the row of the first buttons 101, a second row of second buttons 102 are arranged in the same manner. Each first button 101, is integrally connected with the base 100 by an elastic first arm 103. The second buttons 102 are connected with the base 100 behind the first buttons 101 by elastic second arms 104 which are located between adjacent first buttons 101 as shown in the front view of FIG. 11.

The device of FIG. 11 is produced by using two molds as shown in FIG. 12. A first mold 105 has cavities 107 for molding the front part of the second buttons 102, cavities 108 for molding the front portions of the first arms 103 and a cavity 109 for the front part of the base 100. Another second mold 106 has cavities 110 for molding the rear parts of the second buttons 102, cavities 111 for molding the rear portions of the first buttons 101 and the second buttons 102 and a cavity 112 corresponding to the rear part of the base 100.

The first mold 105 and the second mold 106 are so arranged as to be capable of reciprocating movement. The space formed by the first mold 105 and the second mold 106 in the closed position is then filled with the material of the device and the heat and press treatment follow. Then the multistage button device is produced by separating the first mold 105 and the second mold 106.

Such device produced in said manner can provide a multistage button array integrally formed on the single base plate, which may double the number of buttons and arrange a lot of buttons in a limited space without increasing the number of parts and assembling process.

However the device cannot include two parts which will overlap each other in front and rear thereof on the base plate, since the device is produced by separating two molds (i.e., the first and second molds 105, 106) in the back and forth direction. So the second arm 104 cannot be arranged behind the first button 101 or the first arm 103 but must be arranged between adjacent first buttons 101 (as shown in the front view of FIG. 11). Thus the space corresponding to the width of the second arm 104 must be located between adjacent first buttons 101, which limits the density of the button arrangement.

SUMMARY OF THE INVENTION

An object of the invention is to provide a multistage pushbutton device having an increased number of buttons.

Another object of the invention is to provide a multistage pushbutton device which can be produced by a single mold.

Another object of the invention is to provide a multistage pushbutton device which allows various designs.

A further object of the invention is to provide a method for manufacturing such a multistage pushbutton device.

In accordance with these objects, a multistage pushbutton device of the present invention includes a base. On the base is arranged a first stage pushbutton member, which includes a first elastic arm connected with the base at one end thereof and a first pushbutton provided on the other end of the first arm. A second pushbutton member is provided on the base too. The second pushbutton member has an elastic second arm longer than the first arm and a second pushbutton. One end of the second arm is connected at the base at the position behind the first arm where it does not overlap the first arm in the back and forth direction. The second pushbutton is mounted at the other end of the second arm. At least a part of the second arm overlaps at least a part of the first pushbutton. The first pushbutton member has a drive member projecting from the back thereof which moves at right angles to the pushing direction of the first pushbutton. The second pushbutton member has a drive member projecting from the back thereof which moves at right angles to the pushing direction of the second pushbutton.

The method for manufacturing said device of the present invention comprises three steps. In the first step is prepared a first member for molding which includes cavities corresponding to the front portion of the base, to the first arm connected with the base at the one end thereof, to the front portion of the first pushbutton provided at the other end of the first arm, and to the front portion of the second pushbutton connected at the base at the more distant position from the front portion of the base than the first button position. Then a second member for molding is prepared. The second member for molding has cavities corresponding to the other surface of the base except said front portion and the back portions of the first pushbutton and the second pushbutton. Furthermore, a third member for molding is prepared. The third member is used for forming the front portion of the second arm which connects the second pushbutton to the base and the back portion of the first pushbutton which is placed in front of the second arm. These members for molding are assembled to form the space corresponding to the shape of the multistage button device and the space is filled with suitable material.

BRIEF DESCRIPTION OF THE DRAWINGS

FIG. 1 is a front elevation showing one embodiment of the invention;

FIG. 2 is a plan view of the embodiment of FIG. 1;

FIG. 3 is a side view of the embodiment of FIG. 1;

FIG. 4 is a perspective view of the embodiment of FIG. 1;

FIG. 10A is a section view taken on line V—V in FIG. 9. FIG. 10B is a section view taken on line W—W in FIG. 9.

DETAILED DESCRIPTION OF THE PREFERRED EMBODIMENTS

Figure 11:
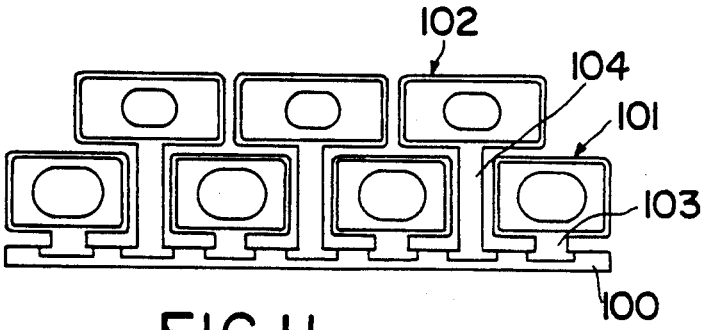
FIG. 11 PRIOR ART
Figure 12:
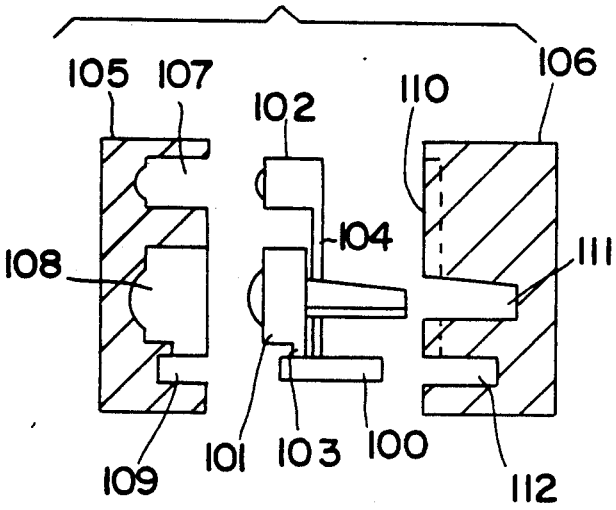
FIG. 12 PRIOR ART

FIGS. 11 and 12 illustrate prior art multistage pushbutton devices and the prior art method of making of such devices.

Now referring to FIGS. 1, 2, 3, 4 and 5, this pushbutton device of the invention comprises a plastic unitary structure. The device includes first buttons 2 arranged in a first stage on a base 1 and second buttons 3 arranged in a second stage on the base 1. Each first button 2 stands on the front portion of the base 1 by virtue of a support elastic arm 20. Each second button 3 is arranged at an "inner" position: i.e., one which is more distant from the front portion of the base 1 than the first button 2. A series of first cutouts 11 are formed at the front portion of the base 1 as shown in FIG. 4. Each second button 3 stands up at the edge of the bottom of a first cutout 11.

Figure 5:
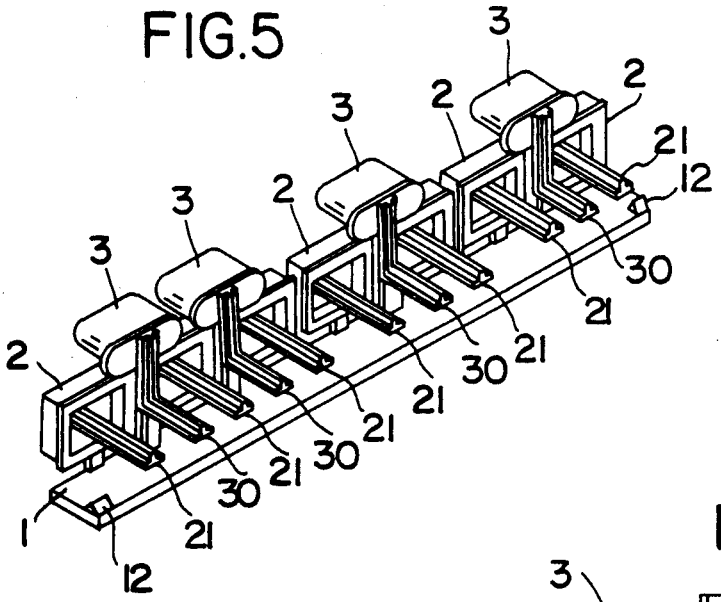
FIG. 5 is another perspective view of the embodiment of FIG. 1.
Figure 6:
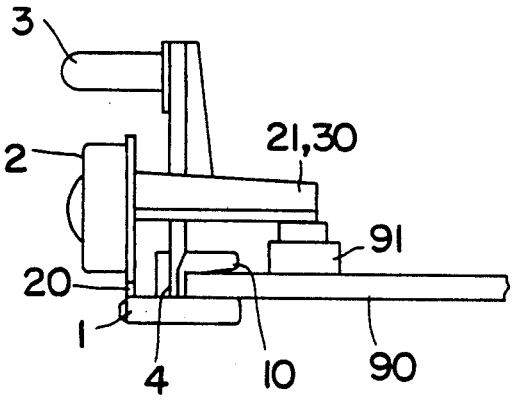
FIG. 6 is a side view showing where the embodiment of FIG. 1 is attached to a base.

Holding pieces 10 of L-shape are arranged at the inner portion of the base 1. Each holding piece 10 stands at the edge of one of a series of second cutouts 13 formed at the front portion of the base 1. At the rear of the base 1 are provided holding projections 12 which taper toward the rear end of the base 1. The holding projections 12 and said holding piece 10 hold a print circuit board 90 (having a push switch 92 thereon) on the base 1 as shown in FIG. 6.

Each first button 2 is integrally connected to the base 1 by a support elastic arm 20 and each first button 2 can move in the horizontal dimension (back and forth direction) by elastic bending of the support elastic arm 20. The support elastic arm 20 is shorter in width than the first button 2 and it connects to the center portion of the lower end of the first button 2. A drive member 21 projects from the back of the first button 2 parallel to the surface of the base 1 so that the drive member 21 pushes the push switch 91 and drives it.

Each second button 3 is integrally connected to the base 1 by a long elastic arm 4 and each second button 3 can move in the horizontal dimension by elastic bending of the long elastic arm 4. The long elastic arm 4 is shorter in width than the second button 3 and it connects to the center portion of the lower end of the second button 3. The long elastic arm 4 is longer than the support elastic arm 20. A drive member 30 projects from the back of the second button 3 and the long elastic arm 4 parallel to the surface of the base 1 so that the drive member 30 drives the push switch 91 or the like.

Figure 7:
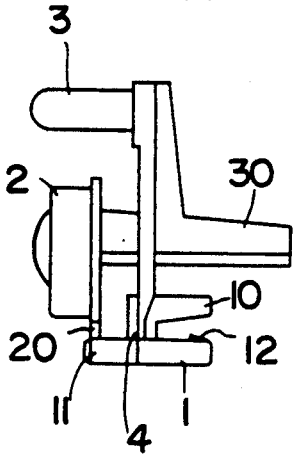
FIG. 7 is a sectional side view of the embodiment of FIG. 1.
Figure 8:
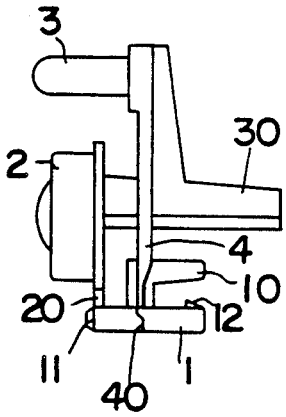
FIG. 8 is a sectional side view of another embodiment.

The long elastic arm 4 stands up from the backmost bottom of the first cutout 11 as shown in FIGS. 4 and 7 so that the second button 3 may be positioned behind the first button 2. The second button 3 has a head projecting toward the front so that the position of the most front surface of the second button 3 in the direction of horizontal movement is equivalent to the front surface of the first button 2. The long elastic arm 4 of the present embodiment is placed behind the space between adjacent first buttons 2 as shown in FIG. 1. The long elastic arm 4 overlaps, in the direction of horizontal movement, both sides of adjacent first buttons 2. Since the space between the first buttons 2 need not have a width corresponding to the width of the long elastic arm 4, the space may be reduced to a minimum. Therefore the density of the arrangement of first buttons can be increased.

The long elastic arm 4 need not necessarily overlap both the side portions of the two first buttons 2 but it may overlap only part of one first button 2 in the front and rear direction. The long elastic arm 4 does not overlap the support elastic arm 20.

The scope of the invention is not limited by said embodiment. Though the front surface of the long elastic arm 4 is almost even to the backmost wall of the cutout 11 in said embodiment as shown in FIG. 7, a cutout 40 may be formed at the wall of the cutout 11 which is concave against the front surface of the long elastic arm 4. With such cutout 40, the strength of a projecting piece 80 of a third mold 8 is obtained as mentioned below when the device is manufactured.

Figure 9:
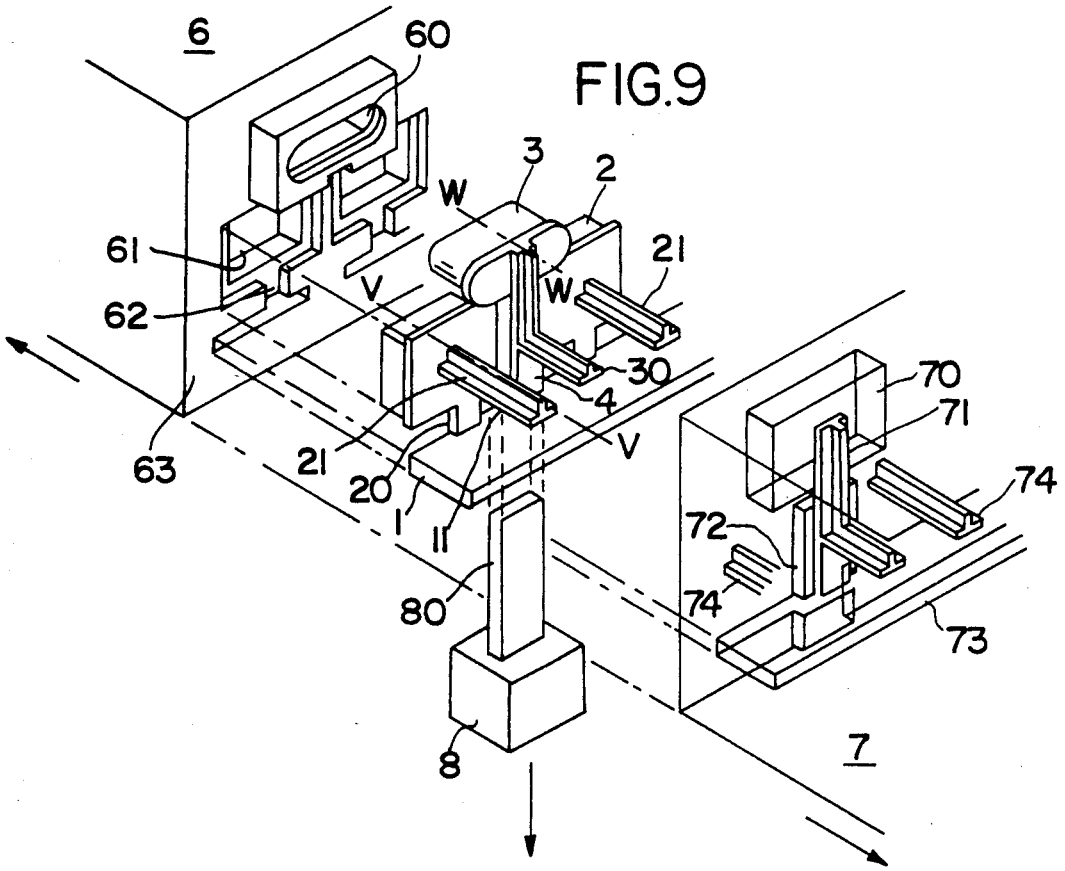
FIG. 9 is an explanatory perspective view showing a method of molding a multistage pushbutton device.
Figure 10A:
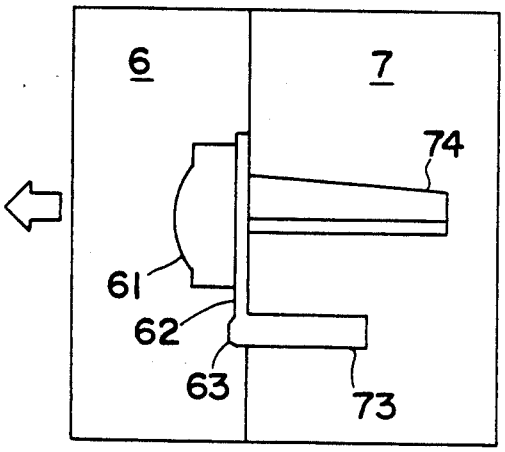
FIGS. 10A and 10B are sectional views of the molds shown in FIG. 9.
Figure 10B:
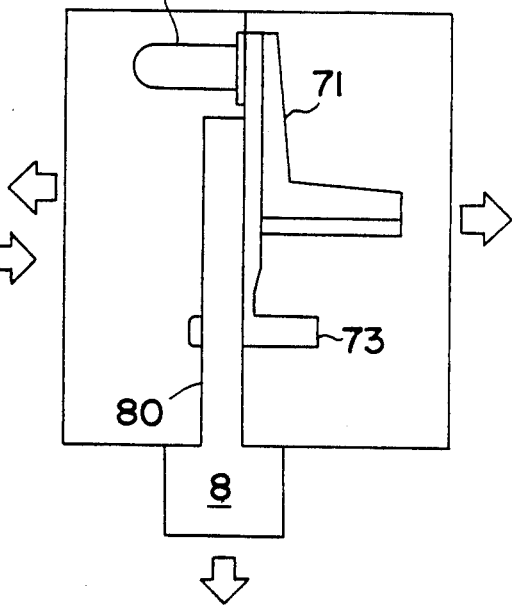

The method for manufacturing said embodiment will now be described with reference to FIGS. 9, 10A and 10B.

The pushbutton device can be manufactured basically by three molds comprising a first mold 6, a second mold 7 and a third mold 8. The first mold 6 has a projecting cavity 60, a cavity 61, a cavity 62 and a cavity 63. The projecting cavity 60 corresponds to the front portion of the second button 3. The cavity 61 corresponds to the front portion of the first button 2. The cavity 62 is formed in connection with the cavity 61 and corresponds to the support elastic arm 20. The cavity 63 corresponds to the front portion of the base 1.

The second mold 7 has a cavity 70 counter to said projecting cavity 60 and a cavity 71 formed behind the cavity 70. The cavity 71 is to form integrally the long elastic arm 4 and the work piece 30 projecting from the back of the long elastic arm 4. A receiving cavity 72 is arranged in front of the cavity 71. The cavity 72 receives a projecting piece 80 of the third mold 8. Furthermore the second mold 7 is provided with a cavity 74 corresponding to the drive member 21 mounted on the back side of the first button 2 and with the cavity 73 corresponding to the back side of the base 1.

The third mold 8 has the projecting piece 80 to form the front portion of the arm 4, the corresponding back side of the first button 2 and the cutout 11. The projecting piece 80 projects from the body of the third mold 8 and the projecting piece 80 is inserted into said cavity 72.

Said first mold 6, second mold 7 and third mold 8 are assembled to form the space of the shape of the device. The first mold 6 and the second mold 7 are arranged so that they can be moved in reciprocating motion as indicated by arrow. The third mold 8 is arranged so that it can be moved in a direction at right angles to said direction of movement of the first mold 6 and second mold 7.

Then a material suitable for the pushbutton device is poured into the space of the assembled first mold 6, second mold 7 and third mold 8. And the necessary heat treatment and pressure treatment follow. Then the first mold 6, a second mold 7 and third mold 8 are separated and the device as shown in FIGS. 1, 2, 3, 4 and 5 is molded.

Said multistage pushbutton device can provide a high density arrangement of buttons because the first buttons 2 and the second buttons 3 are arranged vertically and the long elastic arm 4 is placed behind the first button 2 so that the space between the adjacent first buttons 2 can be a minimum. Furthermore the device may allow various designs because the first button 2 and the second button 3 can be arranged so that they overlap each other in the front an rear direction.

What is claimed is:

1. A multistage pushbutton device used to drive at least one push switch comprising:

a base, at least one first stage pushbutton member which includes a first elastic arm connected with the base at one end thereof and being capable of flexing movement back and forth and a first pushbutton provided on the other end of the arm, at least one second stage pushbutton member which has an elastic second arm longer than said first arm connected with the base at one end thereof and being capable of flexing movement back and forth in a manner which does not overlap the first arm and a second pushbutton mounted at the other end of the second arm, said movement of said second arm being in a manner which overlaps at least part of said first pushbutton, a first drive member projecting from the back of the first stage pushbutton member which moves in the direction nearly perpendicular to the direction of pushing operation of the first pushbutton, a second drive member projecting from the back of the second stage pushbutton member which moves in the direction nearly perpendicular to the direction of pushing operation of the second pushbutton.

2. The multistage pushbutton device used to drive a push switch as claimed in claim 1 wherein:

a plurality of said first stage pushbutton members are provided, said second arm is implanted behind both adjacent sides of the first pushbuttons.

3. A multistage pushbutton device used to drive at least one push switch comprising:

a base, a plurality of first stage pushbutton members which respectively include a first elastic arm connected with the base at one end thereof and being capable of flexing movement back and forth and a first pushbutton provided on the other end of the first arm, at least one second stage pushbutton member which has an elastic second arm longer than said first arm connected with the base at one end thereof and being capable of flexing movement back and forth in a manner which is not right behind the first arm and a second pushbutton mounted at the other end of the second arm, at least the one of adjacent sides of the first pushbuttons conceals at least the part of said second arm in the front view of the base, a first drive member projecting from the back of the first stage pushbutton member which moves in the direction nearly perpendicular to the direction of pushing operation of the first pushbutton, a second drive member projecting from the back of the second stage pushbutton member which moves in the direction nearly perpendicular to the direction of pushing operation of the second pushbutton.

4. The multistage pushbutton device used to drive a push switch as claimed in claim 1 or 3 wherein:

said first stage pushbutton member, said first drive member, said second stage pushbutton member, said second drive member and said base are molded into an unitary construction from resin.

5. The multistage pushbutton device used to drive a push switch as claimed in claim 1 or 3 wherein:

the connecting portion of the base to the one end of the second arm is more concave than the connecting portion of the base to the one end of the first arm.

6. The multistage pushbutton device used to drive a push switch as claimed in claim 1 or 3 wherein:

the connecting portion of the base to the one end of the second arm is concave from the front portion of the base to the even face of the front portion of the second arm.

7. The multistage pushbutton device used to drive a push switch as claimed in claim 1 or 3 wherein:

the connecting portion of the base to the one end of the second arm is concave from the front portion of the base to the inner portion behind the front face of the second arm.

8. A method for manufacturing a multistage pushbutton device which includes multistage pushbuttons mounted on a base and a drive member provided with the pushbuttons respectively at the back side thereof and is used to drive at least one push switch comprising the following steps:

preparing a first member for molding which includes cavities corresponding to the front portions of the base, of a first arm connected with the base at the one end thereof, of a first pushbutton provided at the other end of the first arm, and of a second pushbutton connected to the base at the more distant position from the front portion of the base than the first pushbutton, preparing a second member for molding which includes cavities corresponding to the other surface of the base except said front portion and to each back portion of the first pushbutton and the second pushbutton, preparing a third member for molding which is used for forming the front portion of the second arm which connects the second pushbutton to the base and the back portion of the first pushbutton which is placed in front of the second arm, assembling these members for molding to form the space corresponding to the shape of the multistage pushbutton device and for filling material in the space, and pouring a material suitable for the pushbutton device into said space.

* * * * *